US011846446B1

(12) United States Patent
Shrivastava et al.

(10) Patent No.: US 11,846,446 B1
(45) Date of Patent: Dec. 19, 2023

(54) MODULAR EVAPORATIVE COOLING UNITS

(71) Applicant: Amazon Technologies, Inc., Seattle, WA (US)

(72) Inventors: Saurabh Kumar Shrivastava, Sammamish, WA (US); Usman Khan, Sterling, VA (US); Thomas Yun, Fairfax, VA (US); Peter Ross, Olympia, WA (US)

(73) Assignee: Amazon Technologies, Inc., Seattle, WA (US)

( * ) Notice: Subject to any disclaimer, the term of this patent is extended or adjusted under 35 U.S.C. 154(b) by 233 days.

(21) Appl. No.: 17/350,258

(22) Filed: Jun. 17, 2021

Related U.S. Application Data

(60) Provisional application No. 63/179,903, filed on Apr. 26, 2021.

(51) Int. Cl.
*F24F 6/04* (2006.01)
*F24F 5/00* (2006.01)

(52) U.S. Cl.
CPC ..... *F24F 6/04* (2013.01); *F24F 5/0035* (2013.01); *F24F 2006/046* (2013.01)

(58) Field of Classification Search
CPC ..... F24F 5/0035; F24F 6/04; F24F 2006/046
USPC ..... 261/29, 104
See application file for complete search history.

(56) References Cited

U.S. PATENT DOCUMENTS 5,946,931 A * 9/1999 Lomax ..... B64G 1/58 62/304
5,996,976 A * 12/1999 Murphy ..... B01J 8/009 261/107
7,537,200 B2 * 5/2009 Glassford ..... B01D 61/246 261/104
7,717,404 B2 * 5/2010 Hasegawa ..... B01J 47/12 261/104
8,079,574 B2 * 12/2011 Lin ..... B01D 69/12 261/104
8,137,436 B2 * 3/2012 Calis ..... B01D 71/26 95/52
2004/0245658 A1 * 12/2004 Niland ..... A61M 16/16 261/DIG. 65
2008/0179765 A1 * 7/2008 Van Der Net ..... G03F 7/70933 95/52
2014/0134507 A1 * 5/2014 Fasold ..... H01M 8/04149 261/104
2014/0260369 A1 * 9/2014 LePoudre ..... F28D 15/00 62/314
2014/0326433 A1 * 11/2014 Kozubal ..... F24F 1/0063 165/59

* cited by examiner

*Primary Examiner* — Charles S Bushey
(74) *Attorney, Agent, or Firm* — Kilpatrick Townsend & Stockton LLP

(57) ABSTRACT

An evaporative cooling module may include a cooling media formed from a vapor permeable membrane in which is formed a plurality of pores at a first side and a second side of the vapor permeable membrane. Individual pores of the plurality of pores may be sized to prevent liquid water from passing there through, and enable water vapor to pass there through. The cooling media may be configured to hold liquid water while an air stream is passed through the cooling media. The evaporative cooling module may also include a module inlet to direct liquid water into the cooling media, a module outlet to direct liquid water out of the cooling media, and a frame configured to support the evaporative cooling module.

19 Claims, 7 Drawing Sheets

MODULAR EVAPORATIVE COOLING UNITS

CROSS-REFERENCE TO RELATED APPLICATIONS

This application claims the benefit of U.S. Provisional Application No. 63/179,903, filed Apr. 26, 2021 and titled "MODULAR EVAPORATIVE COOLING UNITS", which is hereby incorporated by reference in its entirety for all purposes.

BACKGROUND

Free air cooling, augmented with water-based direct evaporative cooling, is a frequently used strategy for building cooling. Such direct evaporative cooling technology includes an evaporative media (e.g., a glass-fiber based media) held in a vertical orientation. In operation, water wets the media and is drawn from top to bottom in the media by gravity. The temperature of an air stream that passes through the wetted media is reduced and directed into a building or other enclosure using other equipment.

BRIEF DESCRIPTION OF THE DRAWINGS

Various examples in accordance with the present disclosure will be described with reference to the drawings, in which.

DETAILED DESCRIPTION

Figure 1:
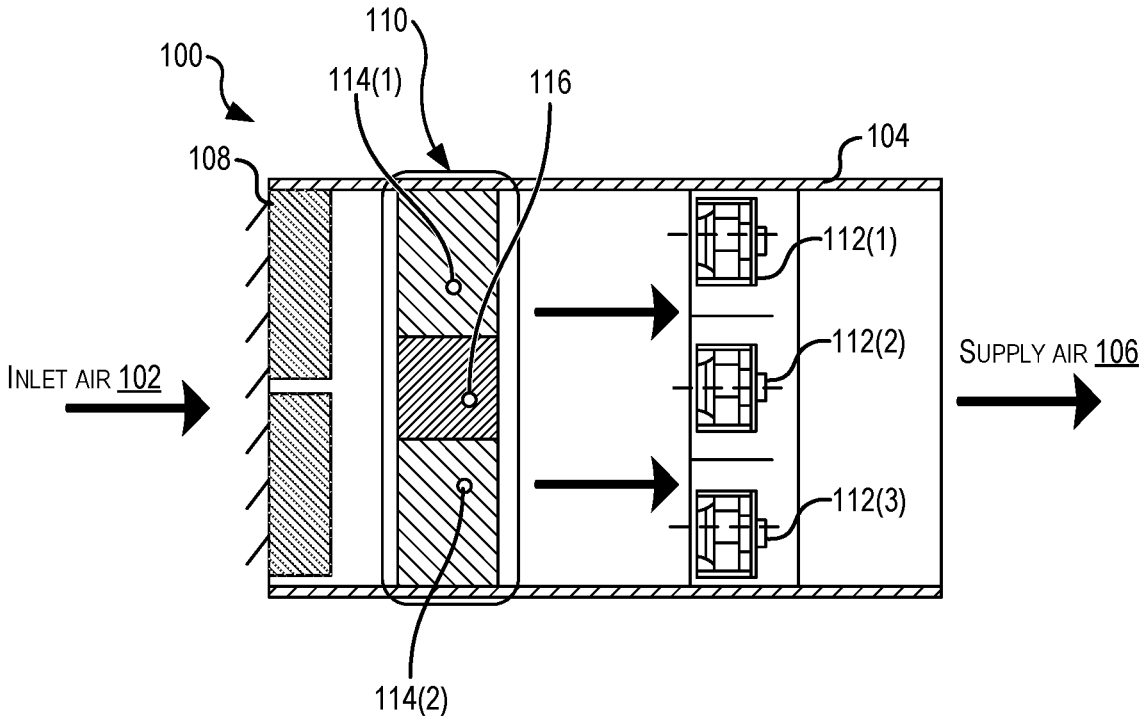
FIG. 1 illustrates an air handler system, according to at least one example.

Examples described herein are directed to modular evaporative cooling units (referred to herein as "evaporative cooling modules"), air handler systems that include one or more modular evaporative cooling units, and techniques for operating such air handlers. The evaporative cooling modules can be designed as self-contained modular units (e.g., a cooling media, an inlet to direct water into the cooling media, and an outlet to direct water out of the cooling media). This enables the evaporative cooling modules to be arranged in many different combinations (e.g., stacked, side-by-side, in V-shapes, and in any other suitable combination) to suit the space in which the air handler system will be installed.

Turning now to a particular example, an air handler system includes an air handler and an evaporative media unit. The air handler is configured to direct an airstream at the evaporative media unit. The evaporative media unit includes multiple evaporative cooling modules arranged in any suitable orientation. The evaporative cooling modules are provided water from a circulating pump that directs water to a water inlet of the evaporative media unit and away from a water outlet of the evaporative media unit. Each evaporative cooling module is in fluid communication with the water inlet via a manifold or other such piping. In operation, water flows through the manifold and into a vapor permeable membrane of the respective evaporative cooling module via an inlet of the respective evaporative cooling module. This same water flows through the respective vapor permeable membrane and out of an outlet of the respective evaporative cooling module. The air handler directs the airstream through the vapor permeable membranes of the evaporative cooling modules. This action cools the airstream. This is because each vapor permeable membrane is configured to retain and direct water between the inlet and the outlet, while also allowing water vapor to escape through miniature holes formed in the membrane as the airstream passes through it. Valves may be provided at the water inlet and outlet and at the inlets and outlets of the evaporative cooling modules. This enables control of water flow at the evaporative media unit level and at the evaporative cooling module level. This granular control when coupled with temperature and other sensors may enable responsive and granular control of the air handler system.

The air handler system described herein may provide various benefits over conventional cooling systems. For example, the air handler system may include flexibility to combine sensible and latent cooling for meeting supply air conditions and capacity requirements. This may allow use of the air handler system to allow a wider range of operations for outdoor temperature and humidity conditions. The air handler system may also enable reduced capital costs through simplification of design and reduction in a part count (e.g., mist eliminator, water distribution system, sump tank and pump, and other parts may be eliminated), as compared to conventional evaporative cooling systems. Because fewer parts are required, operators of air handling systems may see reduced operating and maintenance costs. Additionally, the air handling systems described herein may have smaller footprints as compared to conventional evaporative cooling systems, resulting in space savings. The air handling systems described herein may also enable improved safety and reliability of evaporative cooled data centers or other buildings by limiting aerosolized contaminants' introduction (e.g., water, bacteria) through the cooling system. Additionally, faster and more precise control over cooling systems is possible because air temperature and humidity may be adjusted through partial loading of evaporative cooling modules and quicker response time (e.g., ability to start and stop cooling in under 1 minute, compared to 10-15 min. with conventional media). Reduction of blowdown by 70%, in some cases, is also possible because of increased Cycles of Concentration.

In the following description, various examples will be described. For purposes of explanation, specific configurations and details are set forth in order to provide a thorough understanding of the examples. However, it will also be apparent to one skilled in the art that the examples may be practiced without the specific details. Furthermore, well-known features may be omitted or simplified in order not to obscure the example being described.

Turning now to the figures, FIG. 1 illustrates an air handler system 100, according to at least one example. The air handler system 100 is configured to direct inlet air 102 in the direction of the arrows, e.g., from left to right in FIG. 1, through an enclosure 104 of the air handler system 100 and out as supply air 106. Generally, the air handler system 100 causes the inlet air 102 to be cooled as it becomes the supply air 106.

The air handler system 100 also includes an airflow inlet 108, which may include a set of louvres, an evaporative media unit 110, and one or more air handlers 112(1)-112(3). The evaporative media unit 110, which may be mounted within the enclosure 104 includes one or more evaporative cooling modules 114(1) and 114(2) and a bypass air damper 116. The evaporative cooling modules 114, which are the subject of this specification, will be described in further detail with respect to later figures. The air handlers 112 are configured to pull the inlet air 102 via the evaporative media unit 110. This process cools the inlet air 102. In some examples, the air handlers 112 may be mounted on the opposite side of the evaporative media unit 110 and configured to push the inlet air 102 via the evaporative media unit 110.

Figure 2:
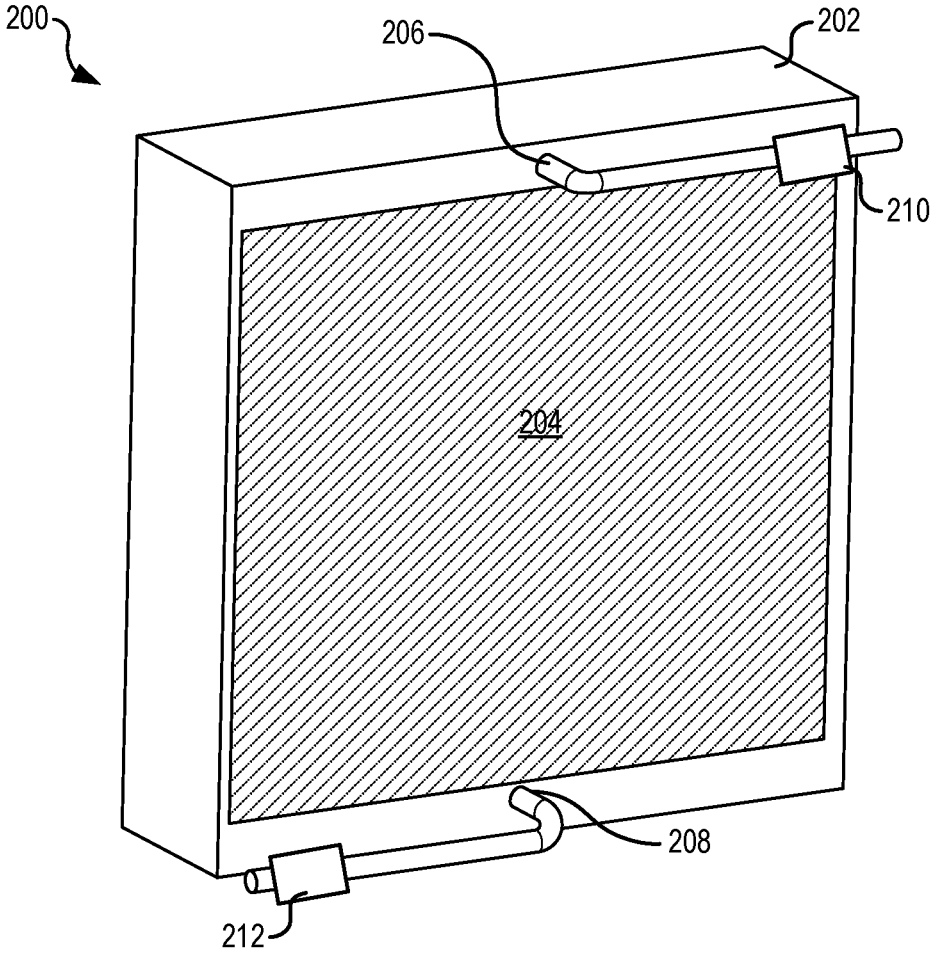
FIG. 2 illustrates a perspective view of an example evaporative cooling module for use in the air handler system of FIG. 1, according to at least one example.

FIG. 2 illustrates a perspective view of an example evaporative cooling module 200 (e.g., the evaporative cooling module 114), according to at least one example. Generally, the evaporative cooling module 200 includes a frame or other structure 202 that is configured to retain a cooling media 204. The evaporative cooling module 200 also includes an inlet 206 for directing liquid water into the cooling media 204 and an outlet 208 for directing the liquid water out of the cooling media 204. Thus, the evaporative cooling module 200 is configured for receiving liquid water into one end and out of a different end, while air is passed from a first side (e.g., a back side) to a second side (e.g., a front side). In some examples, the evaporative cooling module 200 is configured for unidirectional water flow or for bi-directional water flow. In some examples, the evaporative cooling module 200 includes an inlet valve 210 to control water flow at the inlet 206 and an outlet valve 212 to control water flow at the outlet 208. The valves 210, 212 enable the evaporative cooling module 200 to be independently controllable with respect to other evaporative cooling modules 200 included in a cooling system, as described with respect to other figures herein.

Figure 4:
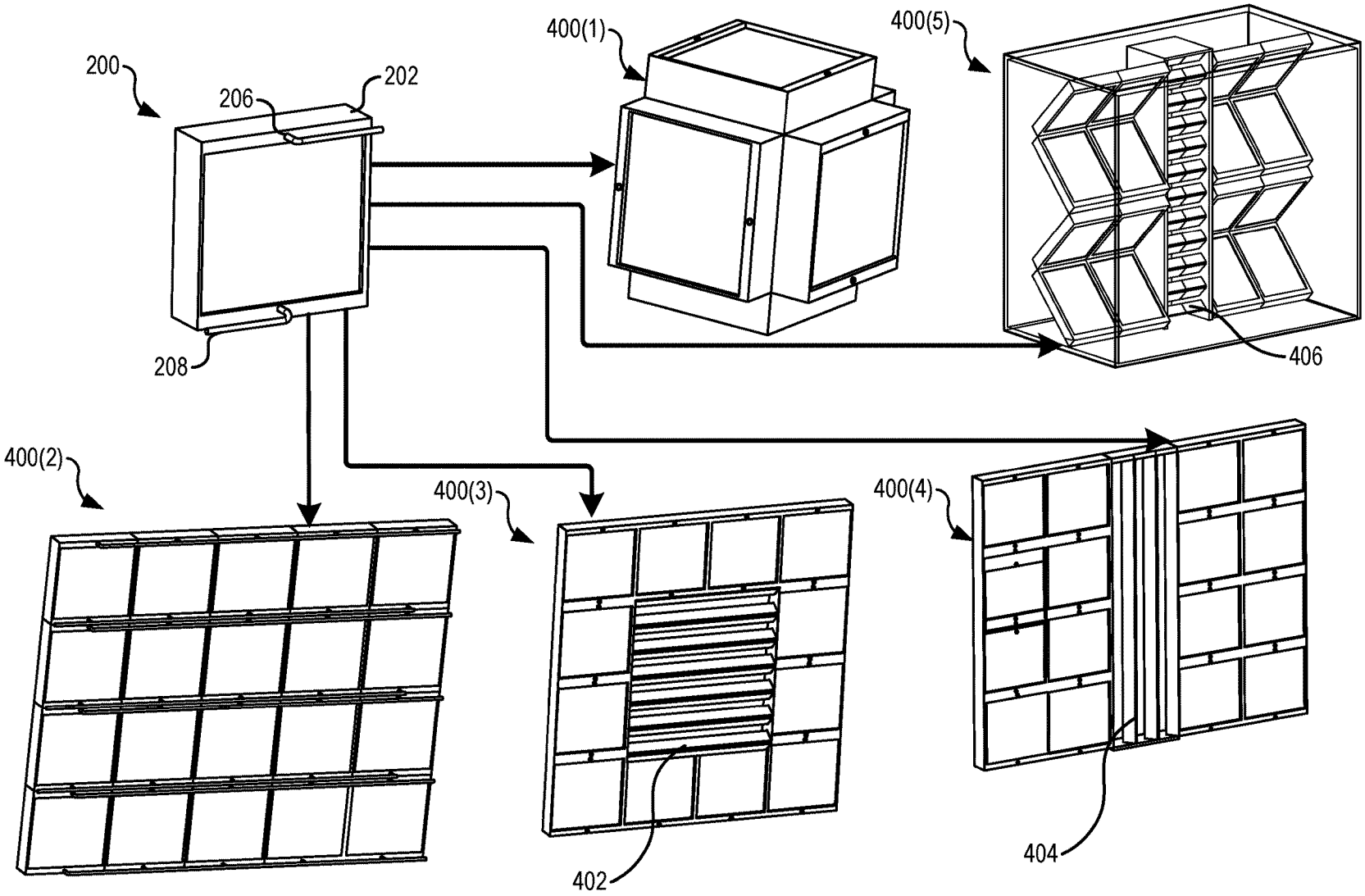
FIG. 4 illustrates an example evaporative cooling module and a few examples of evaporative media units that can be formed from different combinations of evaporative cooling modules, according to various examples.

As described herein, the evaporative cooling module 200 is formed as a modular unit that can be combined with other evaporative cooling modules 200 to build various designs of evaporative media units, as shown in FIG. 4.

The cooling media 204 is formed from a vapor permeable membrane, rather than glass-fiber based media of conventional evaporative cooling systems. Unlike the glass-fiber based media that is wetted and must be held in a vertical orientation, the vapor permeable membrane retains water within the membrane (e.g., within a series of hollow tubes woven together or assembled together to define the membrane, within a space between two membrane sheets to create layers of water and air passages, etc.) and releases water vapor through miniature openings formed in the membrane when air passes by and around the cooling media 204. Because of this and unlike the conventional glass-fiber based media, the evaporative cooling module 200 may be mounted in any orientation (e.g., the evaporative cooling modules are not dependent on gravity for proper operation). In some examples, the vapor permeable membrane may be a woven material formed from a plurality of elongated hollow tubes oriented with first tube ends adjacent to and in fluid communication with the inlet 206 and second tube ends adjacent to and in fluid communication with the outlet 208. As described with respect to FIG. 3, the vapor permeable membrane may be a flat sheet-like material that is used to create layers of water and air passages. Whether flat sheets, elongated hollow tubes, or other designs of vapor permeable membrane, the cooling media 204 is configured to hold liquid water in any one of a vertical orientation, a horizontal orientation, or an inclined orientation while an air stream is passed by the membrane.

Not only can the evaporative cooling module 200 be mounted in any orientation, the evaporative cooling module 200 may be formed into conformal, non-planar shapes in addition to rectangular ones, which is shown. The conformal design and flexibility of orientation allows designing the evaporative cooling module 200 for improved space utilization and performance optimization, as compared to conventional systems. Such conformal design and elimination of gravity dependence, enables simplification of the water distribution system and piping, as compared to conventional systems. The vapor permeable membrane may also have a much longer expected life than conventional glass-fiber based media (e.g., 10 years for membrane vs. 4-8 years for glass-fiber based media). In some examples, the evaporative cooling module 200 may have non-planar profile that defines a curve or a series of curves. This may enable, for example, a cooling system that includes one or more evaporative cooling modules 200 to resemble a cylinder, a triangle, a wave, an L, or any other non-planar shape. In some examples, the evaporative cooling modules 200 may be designed to be mounted within frames that enable rotation about an axis similar to moveable louvers. For example, rather than using a bypass damper with louvers, an entire wall can be formed from a set of evaporative cooling modules 200, and one or more of the modules 200 may be moveable (e.g., rotatable about an axis) to enable air to freely flow from one side of the wall to the second side without having to pass through the cooling media of the other modules 200. In some examples, the entire wall of modules 200 may be rotatable in order to provide maximum air flow through the wall. Continuing with the wall example, in some examples, rather than a coil wall, one or more modules 200 may be used as part of a wall of a building such as a datacenter or other building. The number of modules 200 in the wall can be selected based on thermal loading of the building. In some examples, the entire wall can be in place of or in addition to traditional rooftop air handling units, even those that have been retrofitted to include the evaporative media unit 110.

Figure 3:
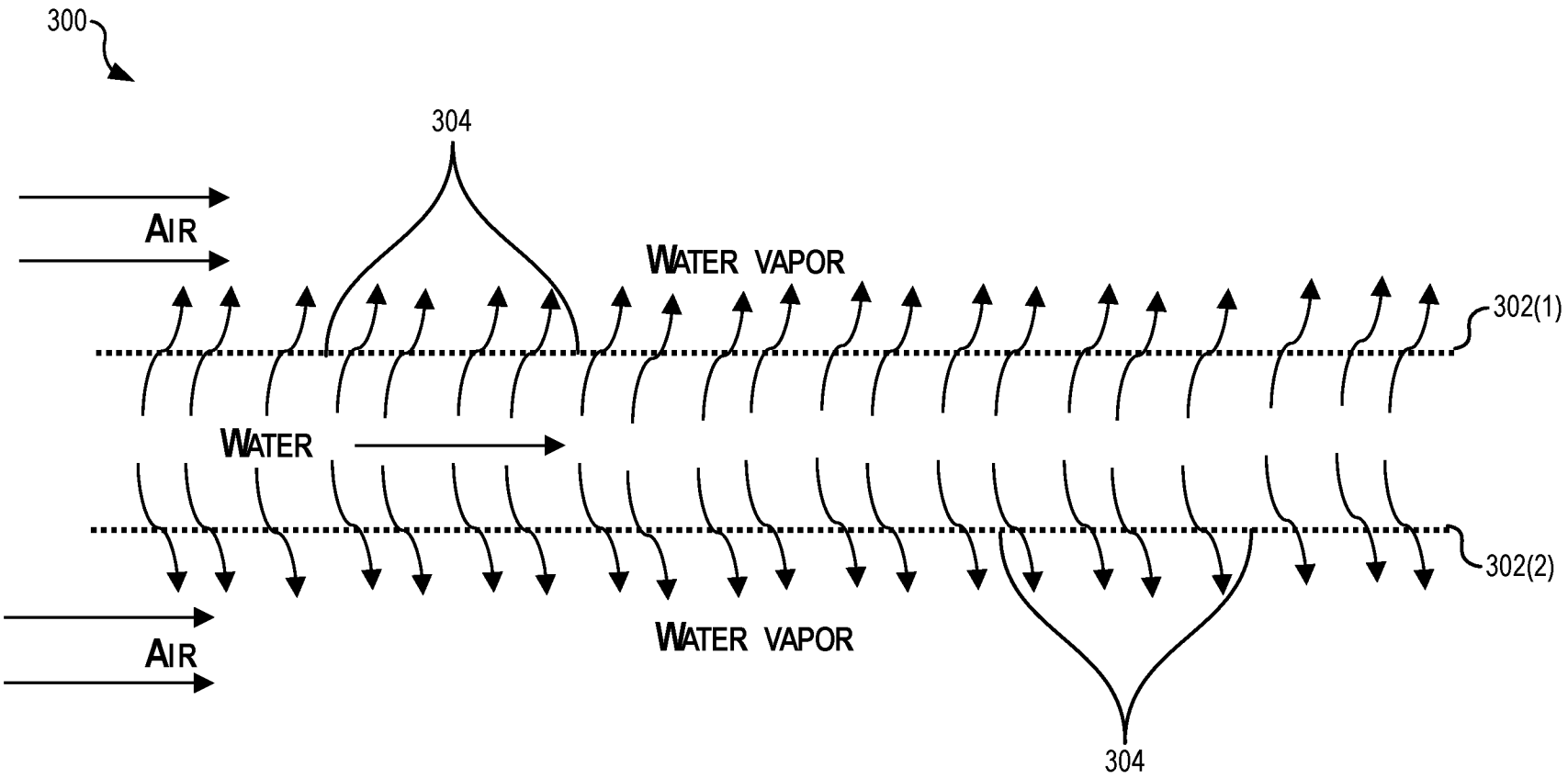
FIG. 3 illustrates a cross-sectional view of a cooling media for use in the evaporative cooling module of FIG. 2, according to at least one example.

FIG. 3 illustrates a cross-sectional view of the cooling media 204, according to at least one example. In some examples, the cooling media 204 may be formed from a vapor permeable membrane 300. The membrane 300 may be of the Liqui-Cel hollow fiber type sold by 3M® Corporation or any other suitable membrane material. For example, the vapor permeable membrane 300 may formed from two or more sheets 302(1), 302(2) of vapor permeable sheets that can be used to create layers of water and air passages. The sheets 302 may be generally parallel and may also be formed from a pliable material. Each sheet 302 may include micropores 304. The micropores 304 formed within the membrane 300 may be about 30 nanometers wide. In some examples, the micropores 304 are less than or greater than 30 nanometers (e.g., have a diameter of about 30 nanometers). For example, the micropores 304 may be 5 nanometers, 10 nanometers, 20 nanometers, 40 nanometers, 50 nanometers, 60 nanometers, less than 5 nanometers, or greater than 60 nanometers. The hydrophobicity of the membrane 300 and the tiny pore size prevent liquid water from passing through the micropores 304 but allows passage of water vapor and dissolved gases. As air runs on the outside of the membrane 300, water vapor from the water surface will diffuse across the porous wall of each sheet 302 (e.g., via the micropores 304) and into the air. In operation, as water vapor is generated, the latent heat of evaporation causes cooling of the air and water. In this manner, the cooling media 204 is configured to cool air that flows through the cooling media 204.

FIG. 4 illustrates an example evaporative cooling module 200 and a few examples of evaporative media units 400(1)-400(4) that can be formed from different combinations of the evaporative cooling modules 200, according to various examples. Generally, the evaporative cooling module 200 may be configured as described in FIG. 2.

As an example, the evaporative media unit 400(1) includes a plurality of evaporative cooling modules 200 that are mounted at the various sides of a rectangular shape. For example, this may include evaporative cooling modules 200 mounted on one, two, three, four, five, or on all six sides of a rectangular cube. The evaporative media unit 400(1) exploits the fact that the evaporative cooling modules 200 may operate in any orientation, not just vertically oriented like the conventional glass-fiber based media.

The evaporative media units 400(2)-400(4) include evaporative cooling modules 200 mounted in a vertically stacked orientation. Though, in some examples, any of the evaporative media units 400(2)-400(4) may be held in a horizontal orientation, a tilted orientation (e.g., having a slope), or in any other suitable orientation. The evaporative media units 400(5) may be held in a V-shaped orientation. This orientation may increase the surface area of the cooling media, as compared to other planar orientations. The evaporative media units 400(3)-400(5) include alternate configurations of dampers 402, 404, and 406. The damper 402 includes horizontally aligned louvers. The damper 404 includes vertically aligned dampers. The damper 406 includes horizontally aligned louvers. In some examples, the evaporative media unit 400(5) may include a damper 406 that is oriented horizontally and/or extends from side to side of the evaporative media unit 400(5). The evaporative media unit 400(2) does not include a damper. In some examples, the evaporative media units 400 may be combined with other elements, as shown in other figures, to create seemingly endless combinations of air handler systems.

Figure 5:
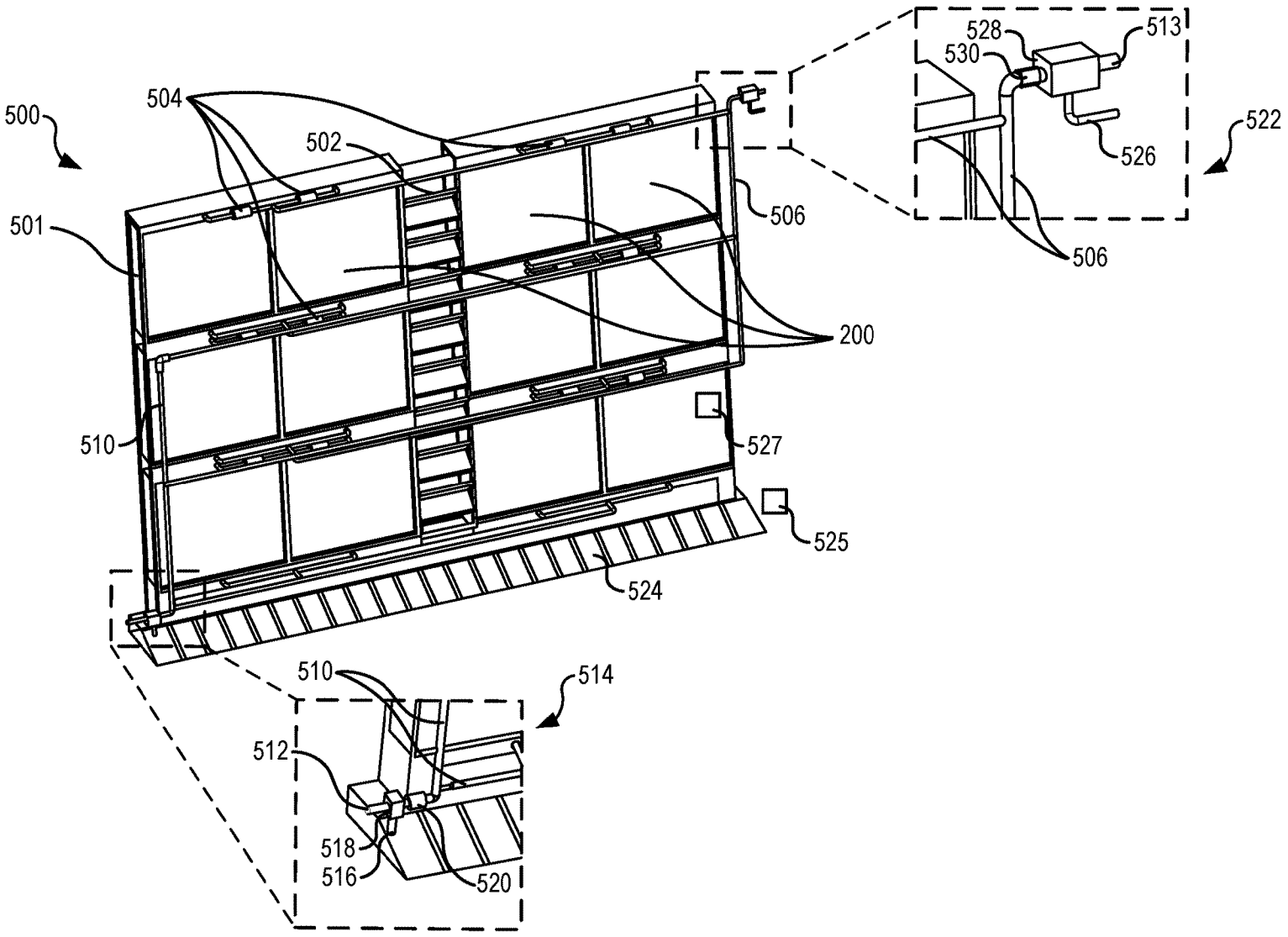
FIG. 5 illustrates a perspective view of an evaporative media unit 500, according to at least one example.

FIG. 5 illustrates a perspective view of an evaporative media unit 500 (e.g., the evaporative media unit 400), according to at least one example. The evaporative media unit 500 includes a unit frame 501 configured to support a plurality of evaporative cooling modules 200 (a few of which are labeled) and a damper assembly 502. As described elsewhere herein, each evaporative cooling module 200 may include a control valve 504 for controlling the flow of water into the respective evaporative cooling module 200. In some examples, the control valve 504 and any other valve described herein may be automated by, for example, being connected to solenoid or other automated device. This may enable automated and selective opening and closing of valves at the evaporative cooling module 200 level and/or at the evaporative media unit 500 level.

The evaporative media unit 500 also includes a distribution header 506 in fluid communication with a unit inlet 513 at each of the respective module inlets. The distribution header 506 may be formed from piping or other material capable of conveying water and configured to do so to each of the respective evaporative cooling modules 200.

The evaporative media unit 500 may be configured to rest upon a drain pan 524 or other structure to catch any residual water that may accumulate on surfaces of the evaporative media unit 500. The evaporative media unit 500 may also include a leak detection sensor 525 configured to detect liquid leaks from the evaporative media unit 500. For example, the leak detection sensor 525, which may include more than one sensor, may be mounted to the floor (or other surface on which the drain pan 524 rests) and be disposed adjacent to the drain pan 524. With this proximity, the leak detection sensor 525 may be configured to detect water that may leak out of the drain pain 524. The evaporative media unit 500 may also include one or more weight sensors 527. The weight sensors 527, one of which may be associated with each evaporative cooling module 200, may be configured to measure an increase in weight of each evaporative cooling module 200 individually and/or the weigh to the evaporative media unit 500 on its own. This may be helpful in determining that an evaporative cooling module 200 should be descaled, cleaned, or otherwise replaced. Thus, the weight can function as a corollary for other operational properties of the evaporative cooling module 200.

As shown in outlet view 514, in addition to the unit outlet 512, the piping may also include a flush/drain outlet 516, an outlet valve 518, and a sensor module 520. The outlet valve 518 may be a three-way valve configured to prevent water from flowing out of either of the outlets 512, 516 or out of one of the outlets 512, 516. The sensor module 520 may include sensors to measure various properties of the water such as temperature, pressure, flowrate, inline conductivity, water leakage, and any other suitable sensor.

As shown in inlet view 522, in addition to the unit inlet 513, the piping may also include a flush/drain inlet 526, an inlet valve 528, and a sensor module 530. The inlet valve 528 may be a three-way valve configured to prevent water from flowing from any of the inlets 513, 526 or from one of the inlets 513, 526. The sensor module 530 may be configured like the sensor module 520 and may therefore include sensors to measure various properties of the water.

In some examples, the flush/drain inlet 526 and the flush/drain outlet 516 may be used to flush the evaporative media unit 500. For example, a cleaning/descaling chemical can be used to flush through the evaporative media unit 500 (e.g., all piping and evaporative cooling modules 200). In addition to cleaning and/or descaling, the flush/drain inlet 526 and outlet 516 may be used for performing water treatment such as chlorination, water softening, and the like.

The evaporative media unit 500 allows granular cooling control capabilities for an evaporative based cooling system by adjusting water temperature and flowrate through the evaporative cooling modules 200. The sensor modules 520, 530 may be used to monitor conditions of the evaporative media unit 500 in order to make such adjustments. In some examples, the operation of the evaporative media unit 500 may be controlled by a computing device (e.g., a processor and memory) including a thermostat to control and monitor air properties. Such a computing device may be configured to coordinate the operation of many evaporative media units 500 operating in different zones of a building. In some examples, the evaporative media units 500 may be controlled from a remote location using telemetry, network connectivity, etc. Unlike conventional evaporative media that typically adapts a complex zoning control, the temperature and relative humidity of process air can be managed by controlling the water temperature and flowrate through the evaporative cooling modules.

A water distribution system for providing water to the evaporative media unit can be designed based on the cooling control requirement. For granular cooling control, the water distribution system may include control valves and piping components, as shown in FIG. 5. Simpler systems that require less control may include fewer control valves and piping.

Numerous components of conventional evaporative coolers can be eliminated when the evaporative media unit 500 is used. These components include, for example, mist eliminator, sump pumps, distribution header, sump reservoir, ultra-violet lamp and other miscellaneous accessories. As a result, the internal configuration for the evaporative media unit 500 may be simpler and more compact than a conventional evaporative cooler.

The various sensors, valves, and control mechanisms may be in electrical communication with a computing device configured to control the operation of the evaporative media unit 500.

Figure 6:
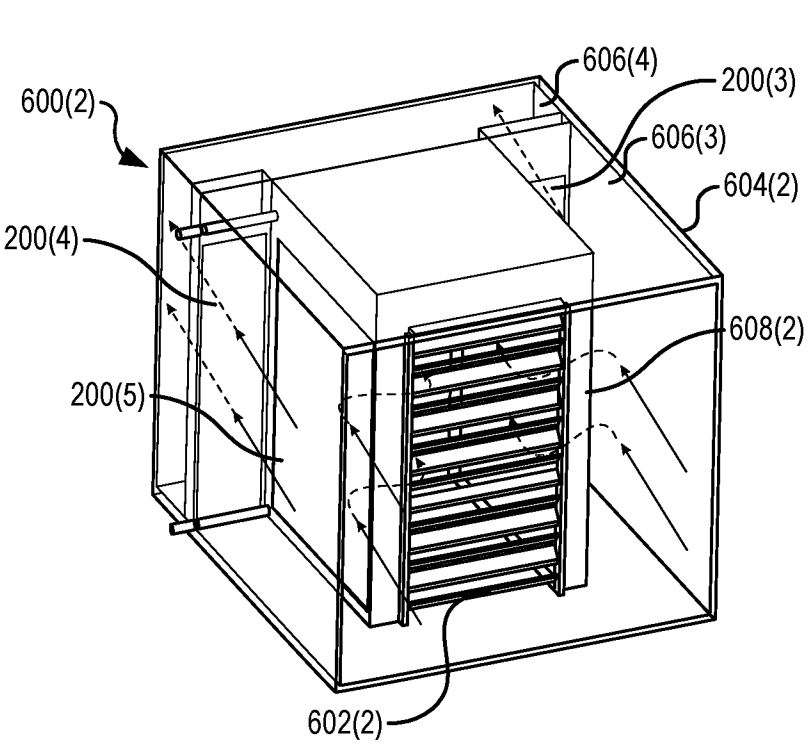
FIG. 6 illustrates various evaporative media units, according to various examples.
Figure 6:
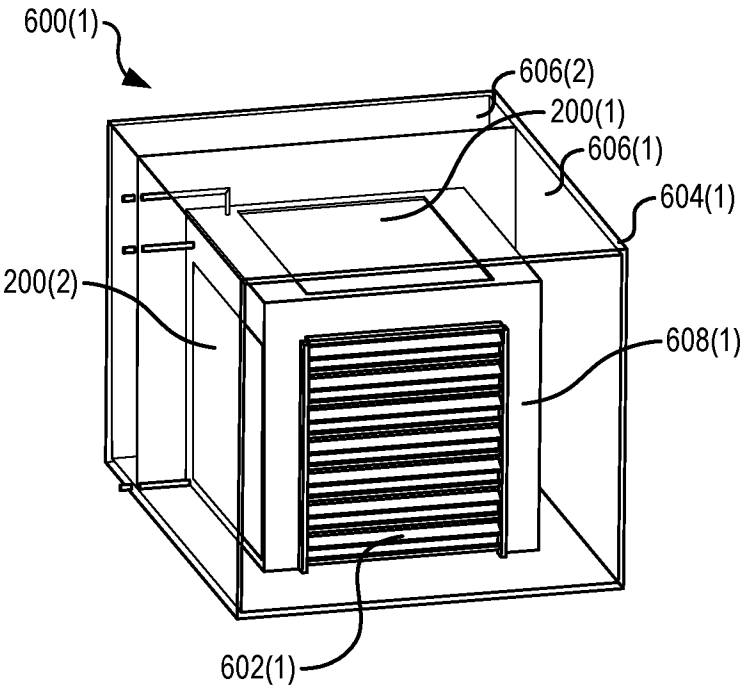

FIG. 6 illustrates various evaporative media units 600(1)-600(2), according to various examples. The evaporative media units 600(1)-600(2) include various combinations of evaporative cooling modules 200 and bypass air dampers 602(1)-602(2). Beginning with the evaporative media unit 600(1), the evaporative media unit 600(1) includes an enclosure 604(1) that is divided into a first volume 606(1) and a second volume 606(2). The bypass air damper 602(1) is mounted to a bypass damper housing 608(1) that is located within the first volume 606(1) and occupies a third volume of the enclosure 604(1). The evaporative cooling modules 200 are defined at three surfaces of the bypass damper housing 608(1). In particular on a top surface and two side surfaces, e.g., the side surface that is visible and a second side surface opposite the visible side surface. When the bypass air damper 602(1) is closed, the air flows through the three evaporative cooling modules 200, which are plumbed into a water circulation system, as described elsewhere herein.

The evaporative media unit 600(2) includes an enclosure 604(2) that is divided into a first volume 606(3) and a second volume 606(4). The bypass air damper 602(4) is mounted to a bypass damper housing 608(2) that is located within the first volume 606(3) and occupies a third volume of the enclosure 604(2). The evaporative cooling modules 200 are defined in an "L" shape, with parts defined at surfaces of the bypass damper housing 608(2) and other surfaces defined in a wall 610 that defines the two volumes 606(3) and 606(4). When the bypass air damper 602(2) is closed, the air flows through the evaporative cooling modules 200, which are plumbed into a water circulation system, as described elsewhere herein.

Figure 7:
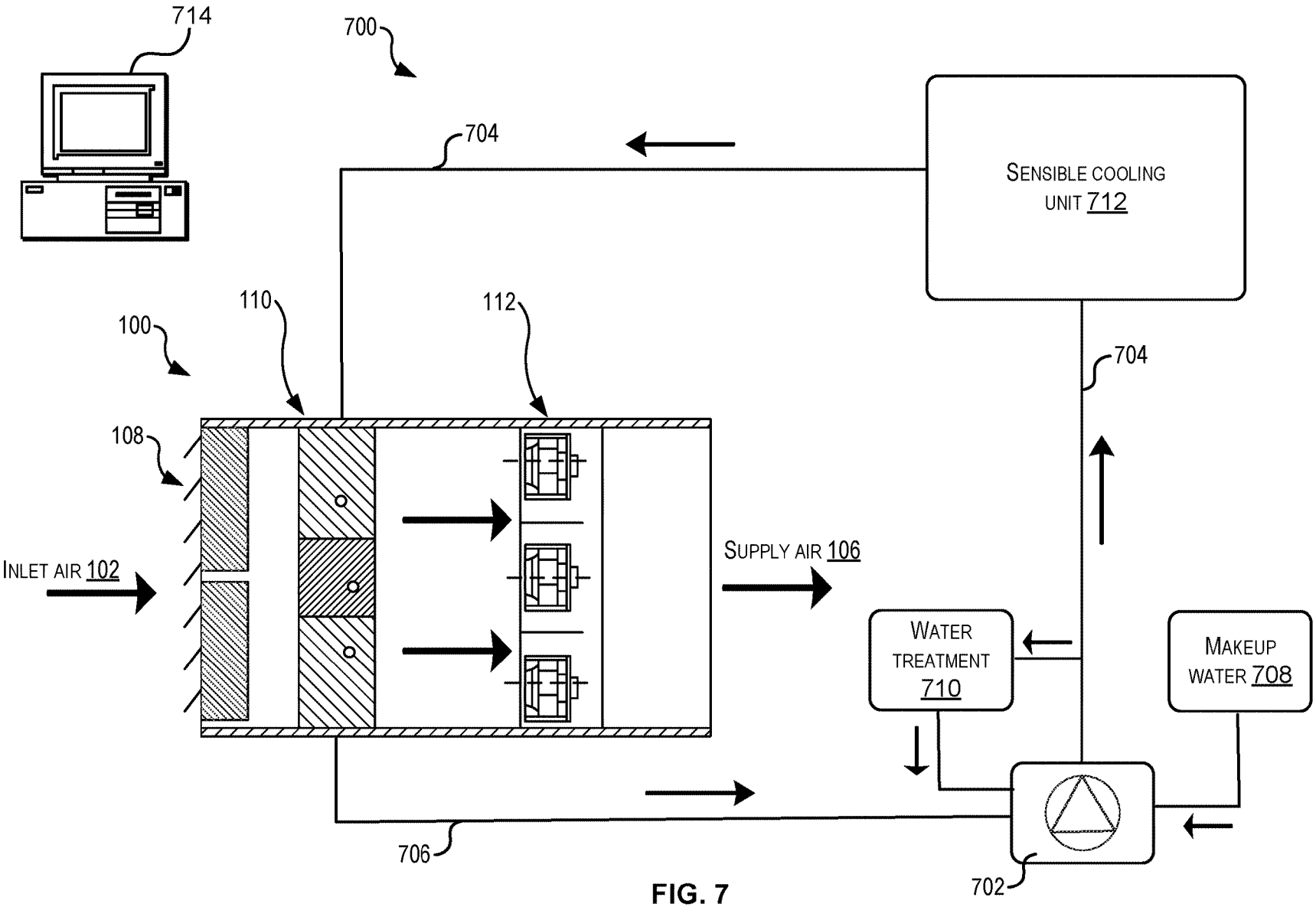
FIG. 7 illustrates a diagram of an example air cooling system 700, according to at least one example.

FIG. 7 illustrates a diagram of an example air cooling system 700, according to at least one example. The air cooling system 700 includes the air handling system 100 described herein. The air cooling system 700 also includes a sump and a pump 702 that circulates water within the air cooling system 700 generally in the direction of the arrows (e.g., in supply piping 704 and return piping 706). In particular, at initialization, the pump 702 may pressurize the system 700 by obtaining water from makeup water 708. The makeup water may include any suitable water source, which may include tap water, well water, surface water, etc. In some examples, the water may be naturally chilled (e.g., lake water or ground water), which may improve the cooling efficiency of the air handling system 100. Water from the makeup water 708 may also be introduced into the system to account for water that is lost during operation of the air cooling system 700. For example, such losses may be attributable to vapor released through the evaporative cooling modules of the evaporative media unit 110. In some examples, the pump 702 may be connected to more than one air handling system 100. For example, a single pump 702 may be plumbed to provide water to two, three, four, or even more air handling systems 100. In some examples, an entire building, including many air handling systems 100, may share a common pump 702.

Water treatment 710 may be used to treat the water within the system 100. For example, chlorine or other chemicals may be introduced in order to minimize organic growth within the system 100. In some examples, the water treatment 710 may also be used to achieve water softening, demineralization, filtration (e.g., reverse osmosis), and other such treatments that may affect the conditions of the water. The water treatment 710 may include the appropriate metering mechanisms to control various water parameters.

The air cooling system 700 may also include a sensible cooling unit 712. The sensible cooling unit 712 may include any suitable combination of a heat exchanger, chilled water loop, trim cooler, chiller, etc., in order to add sensible cooling effect to the system 700. In some examples, the combination of the sensible cooling unit 712 and the air handling system 100 may provide improved cooling as compared to conventional evaporative cooling systems.

The air cooling system 700 may also include a computing device 714 electrically coupled to various components of the air cooling system 700. For example, the computing system 714 may be configured to monitor conditions in an environment and control the operation of the air cooling system 700 to adjust the temperature in the environment. This may include controlling valves, receiving sensing information from sensing modules, controlling the pump 702 to adjust the flow rate of the water through the piping in the system 700, and perform various other control techniques as would be apparent to a person of ordinary skill.

The computer system 714 may be a single computer such as a user computing device and/or can represent a distributed computing system such as one or more server computing devices.

The computer system 714 may include at least a processor, a memory, a storage device, input/output peripherals (I/O), communication peripherals, and an interface bus. The interface bus is configured to communicate, transmit, and transfer data, controls, and commands among the various components of the computer system 714. The memory and the storage device 1106 include computer-readable storage media, such as Random Access Memory (RAM), Read ROM, electrically erasable programmable read-only memory (EEPROM), hard drives, CD-ROMs, optical storage devices, magnetic storage devices, electronic non-volatile computer storage, for example Flash® memory, and other tangible storage media. Any of such computer-readable storage media can be configured to store instructions or program codes embodying aspects of the disclosure. The memory and the storage device also include computer-readable signal media. A computer-readable signal medium includes a propagated data signal with computer-readable program code embodied therein. Such a propagated signal takes any of a variety of forms including, but not limited to, electromagnetic, optical, or any combination thereof. A computer-readable signal medium includes any computer-readable medium that is not a computer-readable storage medium and that can communicate, propagate, or transport a program for use in connection with the computer system.

Further, the memory includes an operating system, programs, and applications. The processor is configured to execute the stored instructions and includes, for example, a logical processing unit, a microprocessor, a digital signal processor, and other processors. The memory and/or the processor can be virtualized and can be hosted within another computing system of, for example, a cloud network or a data center. The I/O peripherals include user interfaces, such as a keyboard, screen (e.g., a touch screen), microphone, speaker, other input/output devices, and computing components, such as graphical processing units, serial ports, parallel ports, universal serial buses, and other input/output peripherals. The I/O peripherals are connected to the processor through any of the ports coupled to the interface bus. The communication peripherals 714 are configured to facilitate communication between the computer system 714 and other computing devices over a communications network and include, for example, a network interface controller, modem, wireless and wired interface cards, antenna, and other communication peripherals.

The memory of the computing system 714 may include a control algorithm. When the control algorithm is executed by one or more processors of the computing system 714, the processors may cause the computing system 714 to perform one or more actions as defined by the algorithm. For example, this may include receiving input sensor information (e.g., from the 530 and/or 520), accessing user-set information (e.g., a temperature and/or humidity set point(s)) for an environment, accessing environment information (e.g., a current temperature and/or humidity of an environment, current temperature and/or humidity of inflow air, etc.) and use this information to control the operation of the air cooling system 700. Controlling the operation may include, for example, opening and closing the valves to the evaporative media unit 110 and/or to the individual modules 200. Controlling the operation may also include, for example, controlling the sensible cooling unit 712 to adjust the temperature of water that is fed into the evaporative media unit 200, controlling water treatment 710 systems, controlling the pump 702 or other flow control mechanism to adjust flow rate and pressure of water being fed into the evaporative media unit 200 and/or into the individual modules 200, control the air handler(s) 112, control the louvers, and perform any other adjustments to enable the system 700 to deliver supply air 106 with the appropriate properties.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated examples thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed examples (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate examples of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain examples require at least one of X, at least one of Y, or at least one of Z to each be present.

Various examples of this disclosure are described herein, including the best mode known to the inventors for carrying out the disclosure. Variations of those examples may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An air cooling system, comprising:

an evaporative media unit, comprising:

a plurality of evaporative cooling modules, each comprising:

a cooling media formed from a vapor permeable membrane that comprises a plurality of pores distributed throughout and sized to prevent liquid water from passing there through, and to permit water vapor to pass there through;

a module inlet to direct water into the cooling media; and a module outlet to direct water out of the cooling media;

a primary inlet to provide water to individual module inlets for the plurality of evaporative cooling modules;

a primary outlet to receive water from individual module outlets for the plurality of evaporative cooling modules;

a pump to provide water at the primary inlet; and a frame configured to support the plurality of evaporative cooling modules; and an air handler configured to move air across the plurality of evaporative cooling modules, wherein, when the pump and the air handler are operational, dry air passes through the plurality of evaporative cooling modules from a first side of the evaporative media unit to a second side of the evaporative media unit and mixes with water vapor that have passed through the plurality of pores.

2. The air cooling system of claim 1, wherein each evaporative cooling module of the plurality of evaporative cooling modules further comprises a module inlet control valve that is configured to independently control the flow of water into the cooling media of the respective evaporative cooling module.

3. The air cooling system of claim 2, further comprising:

a primary inlet valve to control the flow of water at the primary inlet;

a first sensor module configured to sense at least one of temperature or flow rate adjacent to the primary inlet;

a second sensor module configured to sense outlet air conditions; and a computer system configured to:

receive a current outlet air condition from the second sensor module;

determine a difference between the current outlet air condition and an expected outlet air condition; and determine a setting for the pump based at least in part on the difference and sensor information received from the first sensor module.

4. The air cooling system of claim 1, further comprising a water treatment unit to treat water that is provided to the primary inlet.

5. The air cooling system of claim 1, further comprising a heat exchanger configured to cool water that is provided to the primary inlet.

6. An apparatus, comprising:

an evaporative cooling module comprising a cooling media formed from a vapor permeable membrane in which is formed a plurality of pores, individual pores of the plurality of pores sized to:

prevent liquid water from passing there through; and enable water vapor to pass there through, wherein the cooling media is configured to hold liquid water while an air stream is passed through the cooling media;

a module inlet to direct liquid water into the cooling media;

a module outlet to direct liquid water out of the cooling media; and a frame configured to support the evaporative cooling module, wherein the frame is further configured to detachably connect to a different frame configured to support a different evaporative cooling module.

7. The apparatus of claim 6, wherein the evaporative cooling module is configured to operate in a stacked configuration and a V-bank configuration.

8. The apparatus of claim 6, further comprising a module inlet control valve disposed adjacent to the module inlet and configured to control the flow of liquid water into the cooling media.

9. The apparatus of claim 6, further comprising a module outlet control valve disposed adjacent to the module outlet and configured to control the flow of liquid water out of the cooling media.

10. The apparatus of claim 6, wherein the vapor permeable membrane comprises a woven material formed from a plurality of elongated hollow tubes oriented with first tube ends adjacent to and in fluid communication with the module inlet and second tube ends adjacent to and in fluid communication with the module outlet.

11. The apparatus of claim 10, wherein the plurality of pores are formed throughout the plurality of elongated hollow tubes, and wherein the plurality of elongated hollow tubes are configured to hold liquid water in any one of a vertical orientation, a horizontal orientation, or an inclined orientation while the air stream is passed by and between the plurality of elongated hollow tubes.

12. The apparatus of claim 6, wherein the vapor permeable membrane comprises a first membrane layer and a second membrane layer configured to define an interior volume, and wherein the plurality of pores are formed in each of the first and second membrane layers.

13. The apparatus of claim 6, wherein the evaporative cooling module comprises a first side and a second side, and wherein the first side is non-planar with respect to the second side.

14. An apparatus, comprising:

an enclosure defining a first interior volume;

a bypass damper housing disposed within the enclosure and defining a second interior volume that occupies a portion of the first interior volume;

a first evaporative cooling module comprising a first cooling media formed from a vapor permeable membrane, the first evaporative cooling module mounted within the enclosure to enable a first air stream to flow via the first cooling media from the first interior volume to the second interior volume; and a second evaporative cooling module comprising a second cooling media formed from the vapor permeable membrane, the second evaporative cooling module mounted with respect to the enclosure to enable at least one of:

a second air stream to flow via the second cooling media from the first interior volume to the second interior volume; or a third air stream to flow via the second cooling media from a first portion of the first interior volume to a second portion of the first interior volume.

15. The apparatus of claim 14, wherein the first evaporative cooling module is mounted to a vertical surface of the bypass damper housing or a horizontal surface of the bypass damper housing.

16. The apparatus of claim 14, wherein the second evaporative cooling module is mounted to a vertical surface of the enclosure, a vertical surface of the bypass damper housing, or a horizontal surface of the bypass damper housing.

17. The apparatus of claim 14, further comprising a damper mounted to a surface of the bypass damper housing, the damper comprising a plurality of moveable louvres.

18. The apparatus of claim 14, wherein the first evaporative cooling module comprises a first module inlet configured to selectively direct liquid water into the first cooling media, and a first module outlet to direct liquid water out of the first cooling media, and wherein the second evaporative cooling module comprises a second module inlet configured to selectively direct liquid water into the second cooling media, and a second module outlet to direct liquid water out of the second cooling media.

19. The apparatus of claim 14, wherein each of the first and second cooling media is formed from a vapor permeable membrane in which is formed a plurality of pores at a first side and a second side of the vapor permeable membrane, individual pores of the plurality of pores sized to:

prevent liquid water from passing there through; and enable water vapor to pass there through when the respective vapor permeable membrane holds liquid water and the first, second, or third air stream flows through the respective cooling media.

* * * * *